US011220788B2

(12) United States Patent
Sundholm et al.

(10) Patent No.: US 11,220,788 B2
(45) Date of Patent: Jan. 11, 2022

(54) METHOD AND SYSTEM FOR MANUFACTURING A COATED PAPERBOARD AND A COATED PAPERBOARD

(71) Applicant: Kotkamills Group Oyj, Kotka (FI)

(72) Inventors: Filip Sundholm, Kotka (FI); Markku Hämäläinen, Kotka (FI)

(73) Assignee: Kotkamills Group Oyj, Kotka (FI)

( * ) Notice: Subject to any disclaimer, the term of this patent is extended or adjusted under 35 U.S.C. 154(b) by 79 days.

(21) Appl. No.: 15/567,958

(22) PCT Filed: Apr. 19, 2016

(86) PCT No.: PCT/FI2016/050255
§ 371 (c)(1),
(2) Date: Oct. 19, 2017

(87) PCT Pub. No.: WO2016/170229
PCT Pub. Date: Oct. 27, 2016

(65) Prior Publication Data

US 2018/0142418 A1 May 24, 2018

(30) Foreign Application Priority Data

Apr. 20, 2015 (FI) ..... 20155293

(51) Int. Cl.
*D21H 19/82* (2006.01)
*D21H 23/48* (2006.01)
(Continued)

(52) U.S. Cl.
CPC ..... *D21H 19/82* (2013.01); *D21H 19/385* (2013.01); *D21H 19/54* (2013.01); *D21H 19/60* (2013.01);
(Continued)

(58) Field of Classification Search
CPC ..... D21H 19/82; D21H 25/06; D21H 19/60; D21H 19/54; D21H 19/385; D21H 23/48; D21H 27/10; D21H 25/04; D21H 19/30
See application file for complete search history.

(56) References Cited

U.S. PATENT DOCUMENTS 3,839,078 A * 10/1974 Birchall ..... A01G 9/1407 427/377
4,070,398 A * 1/1978 Lu ..... B32B 15/08 206/524.2
(Continued)

FOREIGN PATENT DOCUMENTS

CN 202055095 U 11/2011
EP 0589213 B1 1/2000
(Continued)

OTHER PUBLICATIONS

EP1964971A2 Google Translation (Year: 2007).*
(Continued)

*Primary Examiner* — Francisco W Tschen
(74) *Attorney, Agent, or Firm* — Meunier Carlin & Curfman LLC

(57) ABSTRACT

The present invention relates to a method for manufacturing coated paperboard suitable for packaging paperboard applications. The method comprises coating a first surface of the paperboard web by applying a) a first coating composition in a precoating unit for forming a precoating layer comprising inorganic mineral pigment particles and least one binder for sealing the first surface of the paperboard web; and b) a second coating composition in a curtain coating unit for forming at least one barrier coating layer on the first surface of the paperboard web; and c) a third coating composition comprising a polymer dispersion in the curtain coating unit for forming at least one heat sealable coating layer on the first surface of the paperboard web. The temperature of the
(Continued)

Figure 1:
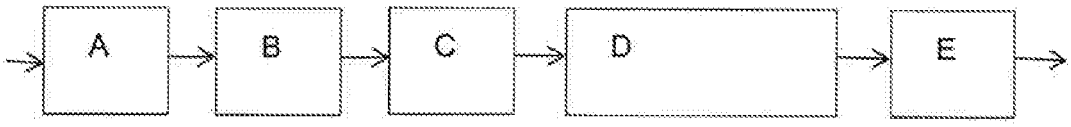

coated paperboard web is controlled and adjusted, and the paperboard web is cooled in at least one cooling unit.

7 Claims, 2 Drawing Sheets

(51) Int. Cl.

| | |
|---|---|
| ***D21H 25/06*** | (2006.01) |
| ***D21H 27/10*** | (2006.01) |
| ***D21H 25/04*** | (2006.01) |
| ***D21H 19/38*** | (2006.01) |
| ***D21H 19/54*** | (2006.01) |
| ***D21H 19/60*** | (2006.01) |

(52) U.S. Cl.
CPC ..... *D21H 23/48* (2013.01); *D21H 25/04* (2013.01); *D21H 25/06* (2013.01); *D21H 27/10* (2013.01)

(56) References Cited

U.S. PATENT DOCUMENTS

| | | | | |
|---|---|---|---|---|
| 4,301,210 | A | 11/1981 | Yasuda et al. | |
| 5,654,039 | A | 8/1997 | Wenzel et al. | |
| 6,548,120 | B1 | 4/2003 | Wittosch et al. | |
| 6,554,899 | B1 | 4/2003 | Ogilvie, Jr. et al. | |
| 7,954,306 | B2 * | 6/2011 | Gould | B32B 27/20 106/31.13 |
| 2002/0060007 | A1 * | 5/2002 | Hollmark | D21F 3/0281 162/132 |
| 2002/0127361 | A1 * | 9/2002 | Sandt | B32B 7/12 428/40.1 |
| 2003/0188839 | A1 | 10/2003 | Urscheler | |
| 2003/0220036 | A1 * | 11/2003 | Lee | B32B 23/02 442/153 |
| 2004/0121079 | A1 * | 6/2004 | Urscheler | B05D 1/305 427/420 |
| 2004/0121080 | A1 | 6/2004 | Urscheler et al. | |
| 2005/0014883 | A1 * | 1/2005 | Blankenship | C08F 2/001 524/458 |
| 2010/0119714 | A1 * | 5/2010 | Bergman | D21F 3/045 427/314 |
| 2011/0111145 | A1 * | 5/2011 | Katampe | B41M 3/12 428/32.72 |
| 2011/0206914 | A1 * | 8/2011 | Hartmann | D21H 19/82 428/212 |
| 2011/0262745 | A1 | 10/2011 | Ronka | |
| 2012/0100340 | A1 | 4/2012 | Valera et al. | |
| 2013/0101865 | A1 | 4/2013 | Ren et al. | |

FOREIGN PATENT DOCUMENTS

| | | | | |
|---|---|---|---|---|
| EP | 1416087 | A1 | 5/2004 | |
| EP | 1964971 | A2 | 9/2008 | |
| EP | EP-1964971 | A2 * | 9/2008 | D21H 19/82 |
| GB | 1225624 | A | 3/1971 | |
| WO | 96/05054 | A1 | 2/1996 | |
| WO | 0066510 | A1 | 11/2000 | |
| WO | 02/053838 | A1 | 7/2002 | |
| WO | 2002084029 | A2 | 10/2002 | |
| WO | 2005000940 | A1 | 1/2005 | |
| WO | 2005/028750 | A1 | 3/2005 | |
| WO | 2006/007239 | A2 | 1/2006 | |
| WO | 2009005947 | A1 | 1/2009 | |
| WO | 2009025739 | A1 | 2/2009 | |
| WO | 2009146023 | A1 | 12/2009 | |
| WO | 2010077203 | A1 | 7/2010 | |
| WO | 2010115597 | A1 | 10/2010 | |
| WO | 2012066308 | A2 | 5/2012 | |
| WO | 2013/189550 | A1 | 12/2013 | |
| WO | 2014/005697 | A2 | 1/2014 | |
| WO | 2015/032432 | A1 | 3/2015 | |

OTHER PUBLICATIONS

Finnish Patent and Registration Office, Search report issued on FI20155293, dated Aug. 10, 2015.

Urscheler,H. et al., Multilayer Curtain Coating—An enabling technology for increased efficiency and new paper grades, Proceedings—22nd PTS Coating Symposium 2005, Sep. 2005, 16 pages.

Shu, Junming et al., Development and Production Experience of the Multilayer Curtain-Coated Linerboard of Ji'an PM3, Tappi Journal, Feb. 2014, 47 pages.

Kimpimäki, Tomi, Dispersion coating and product applications, Paper and Paperboard Converting, 1998, pp. 81-85.

Sangl, Reinhard, Curtain Coating in the Paper Industry—an Update, Paper / Paper Coating, 2010, pp. 9-15.

Blechschmidt, Jürgen, Papierverarbeitungstechnik, 2013, pp. 78-111, 188-189, 198-203, 234-241, 283, 349-350, Carl Hanser Verlag, München.

Ochigbo, Stephen et al., Latex derived blends of poly(vinyl acetate) and natural rubber: Thermal and mechanical properties, Journal of Materials Science, 2009, 26 pages.

Nentwig, Joachim, Kunststofffolien, 3. Auflage, 2006, pp. 102-105, Carl Hanser Verlag, München.

Paltakari, Jouni (ed.), Pigment Coating and Surface Sizing of Paper, Papermaking Science and Technology, 2009, Book 11, excerpt from Chapter 15.

Baumann, W. et al., Papierchemikalien, 1993, pp. 86-87, 92-93, Springer-Verlag, Berlin.

Kuusipalo, Jurkka (ed.), Paper and Paperboard Converting, Papermaking Science and Technology, Book 12, 2nd Edition, 2008, excerpt from Chapter 3.

Habenicht, G. et al., Kleben, Grundlagen, Technologien, Anwendungen, 2009, pp. 113-114 section 2.3.1.4, p. 126, and p. 140, Springer-Verlag, Berlin.

Hung, J. et al., Dring of Coated Webs, Handbook of Industrial Drying, Fourth Edition, 2006, Chapter 40, pp. 931-951.

* cited by examiner

METHOD AND SYSTEM FOR MANUFACTURING A COATED PAPERBOARD AND A COATED PAPERBOARD

PRIORITY

This application is a U.S. national application of PCT-application PCT/FI2016/050255 filed on Apr. 19, 2016 claiming priority of Finnish application FI20155293 filed on Apr. 20, 2015, the contents of all of which are incorporated herein by reference.

The present invention relates to method and system for manufacturing coated paperboard as well as to a coated paperboard according to the preambles of the enclosed independent claims.

For more than ten years the increasing demand for recyclable barrier products, for example, in food service paperboard product category, such as cup stock applications by the end-users, hot and cold drink providers, fast food providers etc., has not been properly acknowledged by the existing suppliers. They have not been able to offer recyclable barrier products at a sustainable cost level. This gap between the demand and supply requires novel technical solutions.

Traditionally food service paperboard or cup stock is produced by utilizing an off-line production technology. The paperboard is thereby produced and winded on the board machine, transported to be further processed with polyethylene (PE) laminating by extrusion technology, and finally, transported further to the end customer. Off-line production demands more machinery and roll transportation, creates more processing waste and it is environmentally challenging, as well as critical regarding transportation damages. When using off-line processing for already once rolled paperboard web it is necessary to unwind the paperboard roll for further processing and roll it anew after the treatment. Typically, off-line processing includes handling and transportation of the paperboard rolls which exposes the paperboard web to defects such as tears, point defects, moisture damages, possible temperature issues, and causes yield loss.

Polyethylene extruded paperboards may be challenging to recycle by repulping. Extruded polymer layer is stretchable due to their long, linear, oriented polymer chains. During repulping the extruded laminated layer is difficult to disintegrate, and it forms easily flakes or agglomerates that disturb the repulping process. Recyclable products have typically been produced totally handmade in small-scale production and are therefore prone to high cost and low volumes.

Polymer based heat sealable dispersions, which are suitable for creating water and/or grease barriers, have been commercially available for a couple of decades. However, due to the challenging process behavior of the heat sealable dispersion needed in, for example, disposable cup stock grade, the use of dispersions have been concentrated on single layer dispersion coating in such board grades where heat-sealing is not needed. Dispersion coatings generally require the reaching of a specific temperature to ensure film forming. However, in the jumbo reel at the end of the coating machine the temperature must not exceed a maximum limit value in order to avoid the heat sealing taking place already in the jumbo reel, gluing the board layers together and making the whole jumbo reel unusable.

The object of the invention is to minimize or even eliminate the problems existing in the prior art.

One object of the present invention is to provide method for manufacturing recyclable, preferably fully recyclable, coated paperboard.

A further object of the present invention is to provide recyclable, preferably fully recyclable, coated paperboard, which is durable while having a thin and resistant coating thereon.

Typical method according to the present invention for manufacturing coated paperboard suitable for packaging paperboard applications, especially for food and/or drink packaging paperboard applications, comprises coating a first surface of the paperboard web by applying a. a first coating composition in a precoating unit for forming a precoating layer comprising inorganic mineral pigment particles and least one binder for sealing the first surface of the paperboard web, and b. a second coating composition in a curtain coating unit for forming at least one barrier coating layer on the first surface of the paperboard web, and c. a third coating composition comprising a polymer dispersion in the curtain coating unit for forming at least one heat sealable coating layer on the first surface of the paperboard web, controlling and adjusting the temperature of the coated paperboard web, and cooling the paperboard web in at least one cooling unit.

Typical coated paperboard according to the present invention comprises a base paperboard and at least a first precoating layer and at least two successive coating layers at least on a first surface of the base paperboard, wherein the first precoating layer comprises at least inorganic mineral filler particles and a binder, a second barrier coating layer having barrier properties is arranged on top of the first precoating layer, and a third heat sealable coating layer is arranged on top of the second coating layer, the third coating layer comprising a heat sealable polymer.

In a typical paperboard manufacturing system according to the present invention for processing lignocellulosic pulp stock into coated paperboard, the system comprises at least a wire section, a press section and a drying section, wherein the system further comprises a coating section, which includes (i) a precoating unit, which is configured to close the pores of at least a first surface of a paperboard web by applying a first coating composition on the first surface of the web, (ii) at least one curtain coating unit, which is configured to provide at least two coating layers on at least the first surface of the paperboard web using a second and a third coating composition, and (iii) at least one adjustable heating unit, which is configured to control and adjust the temperature of the paperboard web and to remove water therefrom, (iv) at least one cooling unit, wherein all the said sections and the said units are included in the same online manufacturing system ending at a jumbo reel wherein the coated paperboard web is wound for the first time.

Now it has been surprisingly found that a coated paperboard with good barrier and heat sealing properties can be effectively and economically obtained by applying on the web surface first a precoat layer and then by curtain coating at least two following coating layers. In this manner a thin multilayer coating is easily obtained. Further, the cooling of the web after coating and heat treatment steps surprisingly provides necessary surface stability, and prevents the tackiness of the surface when reeled. It has been realized that the multilayer coated paperboard with a several thin coated layers according to the present invention can replace conventional extrusion coated paperboard with a polyethylene layer on the surface. Furthermore, it is assumed without wishing to be bound by a theory that use of curtain coating for application of the polymer dispersion onto the web surface produces a coating layer where the polymer chains may be shorter and less oriented than in conventional extruded polyethylene layers. This results in a coating layer that is more easily mechanically disintegrated during repulping. The paperboard according to the invention is thus recyclable and compostable, without any loss of the required barrier properties enabling use, in particular, but not limited to packaging or food service applications.

In the present text the terms "fiber stock" and "pulp stock" are used synonymously and they are fully interchangeable with each other. By fiber stock is meant fiber suspension consisting of 1-4% lignocellulosic fibers and the rest being water and additives, such as wet-end chemicals and inorganic fillers. The fibers may be bleached or unbleached recycled fibers; bleached or unbleached virgin fibers obtained by chemical, mechanical or semi-mechanical pulping processes; or any of mixtures thereof.

In the present text the terms "heat sealable" and "hot melt" are used synonymously and they are fully interchangeable with each other. By heat sealing dispersion in the present disclosure is meant a dispersion of an adhesive polymeric material that melts when exposed to a temperature characteristic to said material. Typical examples of polymeric material dispersion that are suitable for use as a heat sealable dispersion are polyvinyl acetate latex or styrene-butadiene latex.

A paperboard manufacturing system for processing fiber stock into coated paperboard comprises a wire section, a press section and a drying section. These sections are essentially similar to conventional sections found in a regular paperboard manufacturing system and these terms are used in their normal meaning as conventional in the art of paper and board making. By wire section is thus meant the paper/board machine section where water is removed from the stock through a wire by using suction and gravity; by press section is meant the paper/board machine section where water is removed from the web by pressing it between rolls or felts; and by drying section is meant the paper/board machine section where water is removed from web by using steam heated drying cylinders, air dryers and/or infrared dryers or the like. The drying means or predryers preferably comprise drying cylinders which are temperature controlled and configured to preliminarily remove water from the moist web before the application of the precoat layer. After drying the web is directed to the precoater equipment.

All the different sections and units of the system according to the present invention are included in the same online manufacturing system ending at the jumbo reel wherein the paperboard is wound for the first time. The online system is considered to start at the introduction of the web stock into the paperboard web manufacturing installation, i.e. headbox, and to end at the jumbo reel where the paperboard web is wound for the first time.

According to the present invention a first coating composition is applied on the first surface of the paperboard web in a precoating unit. Thus a precoating layer comprising inorganic mineral filler particles and least one binder is formed on the first surface. The precoating layer is needed for sealing or closing the pore structure of the paperboard surface. The materials of the succeeding second and third coating compositions are effectively prevented from penetrating into the base paperboard web by using said precoating with the precoating composition.

The first coating composition for precoating comprises an inorganic compound, which comprises inorganic mineral filler particles, and an organic auxiliary agent, which is a binder. The first coating composition may have solids content of from 40 to 70%, preferably from 60 to 67%. The inorganic mineral filler particles may be selected from particles of carbonates, kaolin or titanium dioxide. More preferably, the inorganic mineral filler particles may be selected from calcium carbonate, including precipitated calcium carbonate and ground calcium carbonate, as well as platy kaolin or any mixtures thereof. The binder in the first precoating composition may be synthetic polymer latex, polyvinyl alcohol or starch. Preferably the binder is a synthetic latex or starch, more preferably styrene butadiene latex or polyvinyl acetate latex. By using optimized compounds in the first coating composition the subsequent coating layers will perform the best.

The precoat weight on the first surface, i.e. the thickness in terms of amount in grammage of the precoating layer, is preferably less than 30 $g/m^2$, more preferably 7-20 $g/m^2$, even more preferably 4-12 $g/m^2$. Costwise the applied precoat layer is preferably as thin as possible, but still thick enough to enable and guarantee the closing of the paperboard fiber web surface from the subsequently applied coating compositions.

The first coating composition is applied on the paperboard web in a precoating unit, which is located after the forming section, press section and the drying section. The precoating unit includes a precoater, i.e. means for coating the paperboard web entering the unit, as well as a postdryer means. The precoater is preferably a size press, such as metering size press. The precoater may be provided with means for applying the first coating composition onto the coating roll(s) wherefrom the coating composition is transmitted onto at least the first surface of the web. Advantageously, both the first side and the second side of the web can be coated, i.e. the precoater is configured to transmit the first coating composition onto both surfaces of the web, preferably simultaneously. The precoated paperboard web is subsequently guided through postdryer means configured to decrease the moisture content of the paperboard web and the applied precoating layer. The precoated surface of the paperboard web is thus dried after the application of the precoat layer and before the application of the second and third coating composition on the paperboard web surface.

After application of the first composition on at least the first surface of the paperboard web, a second coating composition is applied in a curtain coating unit for forming at least one barrier coating layer on the said first surface of the paperboard web. Preferably, the second coating composition comprises material component(s) and/or additives which render the barrier coating layer resistant to water, moisture, grease, mineral oil vapours, odors, heat and/or organic liquids. The barrier coating layer may also have the function of acting as a supporting layer for the third coating layer, to further reduce the risk for mechanical damages to the third layer in the finishing process of a paperboard.

The second coating composition for forming of the barrier coating layer is preferably in the form of a polymer dispersion, more preferably aqueous polymer dispersion. The amount and the thickness and even spreading of the used second coating composition may be controlled better when the coating composition is in a dispersion form. The second coating composition may be latex dispersion, preferably synthetic latex dispersion, polyvinyl alcohol dispersion or polyolefin dispersion. Suitable synthetic latexes that may be used are latexes known in the art, such as styrene butadiene (SB) latex; acrylate latex, such as styrene acrylate (SA) latex or methyl methacrylate latex; or polyvinyl acetate (PVAc) latex, or any of their mixtures, copolymers or derivatives thereof. Many such coating compositions suitable for barrier layers are commercially available and may be used in the present invention.

The amount, i.e. weight, of the barrier coating layer formed by the second coating composition on the first surface is preferably less than 20 g/m$^2$, more preferably 3-10 g/m$^2$, even more preferably 4-9 g/m$^2$. The amount of the second coating composition, which is applied on the first surface of the paperboard web, is preferably controlled by using e.g. a mass flow meter and subsequently determining the layer thickness from the used coating amount. Costwise the applied barrier layer of the second coating composition is preferably as thin as possible, but thick enough to enable forming a barrier between the precoated base paperboard and the heat sealable coating layer.

The second coating composition is applied and the barrier coating layer is formed by using a curtain coating unit. In the curtain coating unit the web is guided through at least one curtain coater. Curtain coaters are commercially available equipment. The preferred curtain coater is configured to coat at least two, possibly several, coating layers at the same time from different, separate, slots. The laminar flows of the coating compositions from the different coating slots thus enable immiscibility of the applied coating compositions. This means that the second and third coating compositions are applied simultaneously as separate layers on top of each other onto the first surface of the paperboard. By applying the second and third coating layers simultaneously, coatings with different properties may be combined to achieve a cost efficient product where different barrier demands can be successfully combined into a single paperboard product. Furthermore, when the second and third coating layers are applied on the first surface of the paperboard with curtain coating as aqueous dispersions without intermediate drying between the coating layers, the layers do not repel each other but may form an effective layered barrier structure.

The paperboard web may be coated with multiple layers from only one surface or from both surfaces. If both surfaces are coated, preferably, two successive curtain coaters are used.

The third coating composition is applied in the curtain coating unit for forming at least one heat sealable coating layer on the first surface of the paperboard web. Preferably the third coating composition is applied in the same curtain coating unit than the second coating composition, which is adapted for multilayer curtain coating of at least two different coating compositions.

The third coating composition comprises a polymer dispersion for producing the heat sealable coating layer. The polymer dispersion is preferably a hydrocarbon polymer dispersion, more preferably synthetic hydrocarbon polymer dispersion. The synthetic hydrocarbon polymer dispersion is preferably polyvinyl acetate latex or styrene-butadiene latex, possibly also styrene acrylate latex. The third coating composition for forming of the heat sealable coating layer is preferably in the form of an aqueous dispersion of the suitable polymer. The polymer in the dispersion readily melts once the ambient temperature is elevated to or above the softening and/or melting point thereof, which enhances the film formation. Moreover, the polymer in the heat sealable coating layer is able to melt sufficiently within the commercially used packaging machines, enabling formation of seams between the paperboard layers, i.e. providing the gluing effect in final packaging applications. In present packaging processes, hot air, ultrasonic sealing, hot metal clamps or similar devises are used to heat seal the carton packages, disposable cups or similar products. The coated paperboard produced according to the invention with a suitable heat sealable dispersion polymer can be sealed by the same sealing processes, with settings adjusted to suit the polymer.

The third coating composition may also comprise at least one additive agent, which provides desired properties for grease and/or water barriers, as well as for further improving heat sealability.

The weight of the heat sealable coating layer on the first surface, i.e. the thickness of the heat sealable coating layer, may be less than 20 g/m$^2$, preferably in the range of 5-12 g/m$^2$, more preferably in the range of 6-9 g/m$^2$. The applied heat sealable coating layer is preferably as thin as possible, but still thick enough to enable forming a barrier on top of the precoated and barrier coated base paperboard and the ambient of the paperboard application, such as hot or cold aqueous liquids.

When applied onto the web surface together with the barrier coating layer and dried, the heat sealable dispersion coating layer is forming a homogenous film. This film is, however, not as stretchable as the conventionally used extruded polyethylene film. Due to this difference, the used packaging paperboard product, which comprises the coated paperboard of the present invention, may be directly recycled or composted as such. During conventional repulping in a recycling process, all components, including polymeric material from the heat sealable coating layer, disintegrate.

According to one preferable embodiment, both the second and third coating compositions are in the form of aqueous dispersions, preferably aqueous dispersions comprising a polymer based component, more preferably aqueous dispersions comprising a polymer based component which is selected from polyvinyl acetate or styrene butadiene, as the main dispersed component.

The second coating composition may also comprise a polymer dispersion, preferably synthetic hydrocarbon polymer dispersion, which is suitable for forming a heat sealable coating layer. In this case also the barrier coating layer may function as a heat sealable coating layer.

According to one embodiment the second and third coating compositions may be identical to each other.

The second and third coating compositions may preferably be different from each other to produce a final product with the required barrier and heat sealing properties.

After the application of the second and third coating composition on at least the first surface of the paperboard web in a curtain coating unit, the web is transferred to a heating unit, where controlling and adjusting the moisture content and the temperature of the paperboard web can be performed. According to one embodiment of the invention the temperature of the heat sealable coating layer is adjusted to a temperature level, where the dispersed polymer in the heat sealable coating layer is at least partially or fully melted during film forming. The elevated temperature in the heating unit melts the polymer particles at least partially at least in the heat sealable coating layer, optionally also in the barrier coating layer. This enables the formation of layered polymer film(s) on the surface of the paperboard web. The curtain coating unit is thus succeeded with at least one adjustable heating unit, which is configured to control and adjust the temperature of the paperboard web and to remove moisture from the coating layer(s) and facilitate the film formation in the second and/or third coating layer. The heating unit preferably comprises a hot air drying hood.

Temperature control of the web after the application of the second and third coating layer in the curtain coating unit is important. Too low drying temperature causes an incomplete film formation and does not provide the desired functionalities for the obtained final paperboard, while too high temperature causes problems with sticky paperboard and/or with bubble formation in the coated layer. Too high drying temperature may also require excessive cooling. Preferably, the temperature of the coated web during the heat treatment is at least 90° C., preferably at least 100° C., more preferably from 100-150° C., even more preferably 100-130° C., most preferably 110-120° C.

The heating unit preferably comprises electrical and computing means for operating it. In one embodiment the adjustable heating unit comprises means for controlling the temperature, e.g. of the heater element, which is used to dry the paperboard web, by using a predetermined algorithm calculating the energy output of said heating unit. In another embodiment the adjustable heating unit comprises sensing means for measuring the actual temperature of the paperboard web surface at said unit. The actual temperature of at least one surface of the web is measured, preferably the actual temperature of both surfaces is measured. The temperature measurement can be performed by using an electrical temperature sensor, preferably connected to a computing device and to the means for controlling the temperature of the heater element. Electrical and computational means are provided for connecting the actual temperature reading to the energy output required from the heater(s) of the heating unit and for carefully controlling the temperature profiling in the machine direction.

In one embodiment of the present invention the paperboard web is guided through a curtain coating unit and subsequently along a plurality of successive heating units, preferably three successive heating units, as described above. In another embodiment of the present invention the paperboard web is first guided through a first curtain coating unit and subsequently along a plurality of successive heating units, preferably three successive heating units, for coating the first surface of the web, and subsequently, the paperboard web is guided through a second curtain coating unit, and subsequently along a plurality of successive heating units, preferably three further successive heating units, for coating the second surface of the web.

After the heating unit the paperboard web is cooled in at least one cooling unit. The cooling unit cools the web down after it has been heated. The cooling unit is especially advantageous as it cools the web before winding of the coated paperboard web into the jumbo reel. In this manner it is possible to ensure that the surface temperature of the web is low enough to avoid sticking of the web surfaces together when winding and the following storage. In an exemplary embodiment the temperature of the web after the temperature adjustment in the heat treatment may be cooled down in the cooling unit down to a temperature below 50° C., preferably below 45° C., more preferably below 40° C., before winding of the coated paperboard web. Cooling reduces the tackiness of the coated web surface and enables better processability for the winding.

Use of a specific temperature controlled drying strategy as described in the coating section it is possible to exceed the critical top temperature required to initiate the melting or polymerization reaction and simultaneously not to exceed the maximum temperature in the jumbo reel. The temperature at the end of the coating section is preferably controlled by a cooling unit.

In one preferable embodiment of the present invention the manufacturing system further comprises at least one calendering unit. By calendering is achieved paperboard surface treatment by using mechanical load, friction and temperature. As a result surface is smoother, glossier and paperboard is thinner. The paperboard web may be calendered after the precoating unit and/or before and/or after the cooling unit. Preferably the calendering unit is installed at least after the precoating unit. Calendering unit after the precoating unit improves the sealing and closure the precoated surface of the paperboard web by mechanically pressing the precoating layer and increasing the impermeability thereof. Calandering after the application of the precoating reduces the porosity and improve the smoothness of the precoated paperboard.

Alternatively or in addition a calendering unit may also be installed before and/or after the cooling unit. This allows a flexible surface treatment to satisfy different customer needs. For example, with the help of a cooling unit, calendering and electrical surface treatment wide range of customer requirements may be settled.

Any suitable calendering unit may be used. Typical calendering units suitable for this purpose are heated or unheated, single or multinip, calenders with hard or soft rolls, shoe nip or metal belt calenders.

The paperboard web having at least the first surface coated with the precoating layer, barrier coating layer and heat sealable coating layer may be exposed to the electrical surface modification treatment, e.g. by charging, before winding of the said coated paperboard web onto jumbo reel. In one embodiment of the present invention, the system thus further comprises an electrical surface modification unit. This unit is configured to modify the energy of at least one of the paperboard web surfaces. Preferably, the surface energy of the paperboard web is modified using a corona treatment apparatus, or the like. This equipment is commercially available. Preferably the electrical surface modification treatment is capable of changing the surface energy of the first surface of the coated paperboard web. The electrical power used in the surface modification treatment is preferably less than 50 $W/m^2/min$, more preferably less than 40 $W/m^2/min$, most preferably 15-30 $W/m^2/min$. Especially, if the final paperboard is produced into a consumer product, e.g. paperboard cup, the electrical surface modification provides a surface enabling different types of printing methods to be easily applicable. The system of the present invention allows producing online paperboard surfaces with attractive printing properties. This eliminates the need for off-line treatments enhancing the printability of the paperboard surface.

Conventionally, the printing of the polymer coated paperboards is done before the off-site lamination of a plastic coating to ensure high print quality as the closed surface of the laminated plastic coating layer doesn't allow the printing ink solution to penetrate into the surface. In the system of the present invention there is, optionally, an electrical surface modification unit provided online, such as a Corona treatment unit, installed in the end of the coating section. This unit changes the electric charge of the surface and aids in adhering the printing ink to the polymer coated surface.

The system may further comprise means for removing air from at least one of the coating compositions used in the coating section. It is advantageous to remove most of the included air from the coating composition to enable a defect free coating layer. The possible defects in the formed coating, which result from air bubbles in the coating composition, allow further coating compositions subsequently applied onto the surface to penetrate through the coating layer(s) into the base paperboard. Preferably, said means for removing air comprise an underpressure pump, such as vacuum pump, capable of removing the included air by reducing the pressure from atmospheric pressure to a reduced pressure, e.g. near vacuum.

The system may further comprise means for measuring the amount of each coating composition applied. By measuring the applied amount of each coating composition applied the coating film thicknesses may be calculated accurately. This removes the need to actually measure the layer thicknesses. Preferably, said means comprise a mass flow meter or the like, capable of determining the applied amount accurately. According to one preferable embodiment the coat weight of the barrier coating layer and the heat sealable coating layer, especially the coat weight of the heat sealable coating layer, are accurately controlled. Too high coat weight reduces the profitability of the production process due to high price of the dispersion coating chemical and too low coat weight does not create the required heat sealing property in the paper cup manufacturing machine.

According to one embodiment the base paperboard web is coated by applying the first coating composition on both the first surface and on a second surface of the paperboard web. The barrier coating layer and the heat sealable coating layer are subsequently applied only on the first side of the precoated web, and the coated web is subjected to a heat treatment according to a predetermined machine direction temperature profile. In this manner a coated paperboard is obtained where the first surface comprises a multilayer coating and the second surface only precoating layer. According to a further alternative, after this the second side of the web is also coated with a barrier coating layer and a heat sealable coating layer, and the heat treatment is renewed. In this manner a coated paperboard is obtained where both the first surface and the second surface comprises a multilayer coating.

With the above described machinery a tailor made final product may be produced. For example, one or both sides of the paperboard web surface may be coated with one or up to 3 different coating layers using web temperature control and electrical surface adjustment to enable optimized final paperboard surface properties.

Preferably, the coated paperboard product is manufactured using the method of the invention as described above. The coated paperboard product comprises a base paperboard and at least a first precoating layer and two successive coating layers at least on a first surface thereof. The coated paperboard is especially suitable for use as a packaging paperboard having barrier properties, such as e.g. food service paperboard.

By base paperboard in the present disclosure is meant a base paperboard, which prior the coating of the layers has a basis weight or grammage from 150 to 550 g/m$^2$ or from 150 to 500 g/m$^2$. Preferably the base paperboard has a basis weight or grammage from 175 to 400 g/m$^2$, more preferably 175 to 350 g/m$^2$.

By paperboard is meant a coated paperboard, which after the coating of the at least three layers has a grammage from 170 to 540 g/m$^2$. Preferably the coated paperboard product has a basis weight or grammage from 195 to 420 g/m$^2$, more preferably 195 to 370 g/m$^2$.

According to one embodiment of the invention the total weight of the applied coating layers on one side, including the precoat layer and all the succeeding layers applied with the curtain coating, is <30 g/m$^2$, preferably <25 g/m$^2$, more preferably <22 g/m$^2$. The present invention provides for application of plurality of thin coating layers while maintaining the total coatweight at low level.

In the present invention the extrusion coated polyethylene layer on the surface of the paperboards available by the existing conventional products on the market is replaced by multiple separate thin layers, which are successively coated on the paperboard surface. The second and third coating layers are preferably made of dispersion materials, i.e. by using dispersions as coating solutions, and the coated layers render the final coated paperboard product recyclable, preferably fully recyclable. No additional processing steps besides the typical mechanical disintegration into an aqueous fiber pulp are needed at the repulping step of the used final product. Disintergrating of the coated fiber board product into fibers and polymeric particles smaller than the fibers at recycling is enabled by regular mechanical aqueous milling. No additional separation of polymeric layers from the cups or paperboard packages is necessary before recycling them. This means that the paperboard products, manufactured according to the present invention, are much easier to recycle, both technically and economically.

A further advantage is that the recyclability is obtained without any significant loss of barrier properties. Advantageously, the product of the present invention exhibits no loss of barrier properties compared to the extrusion coated paperboards. The obtained multilayer dispersion surface according to the invention is non-permeable to hot or cold alcoholic and/or non-alcoholic aqueous liquids with an alcohol content of less than 20%.

According to one embodiment of the invention the coated paperboard product is preferably coated from both sides using the at least three coating layers, namely the precoating layer, the barrier coating layer and the heat sealable coating layer. Especially, if the coated paperboard is intended to an end use application, such as cold cups, at least three coating layers are preferably applied on both sides of the paperboard. On the other hand, if the coated paperboard is intended to an end use for hot cup application, single sided multiple coating on the first surface may suffice.

A paperboard product, preferably a barrier packaging paperboard product can be made by using paperboard according to the present invention. By using a multilayer coating process with multiple coating units it is possible to create paperboard suitable for many new end-use areas, currently unforeseen. The new packaging materials thus created from the multilayer coated paperboard with the coating technology of the present invention provide practically unlimited combinations between dispersion and pigment coating formulae and enable entering totally new markets. For example the produced coated paperboard may be suitable for products, such as hot cup, cold cup, espresso cup, medicine pill dosing cup, cereal or powder box, cereal or powder bag, or barrier coated paperboard products. The use of the multilayer paperboard structure of the present invention allows reaching low basis weight, which creates new end use areas, such as medicine pill dosing cups, espresso cups or the like, where 100% plastic cups are being used at the moment. According to one alternative, a dispersion coating on the first side of the paperboard and standard pigment coating required by high quality printing on the second side of the paperboard it is possible to replace the separate inside plastic bag in for example cereal and other dry food and powder boxes. In general the products according to the present invention are able to replace plastic and other non-recyclable packaging materials by fiber based paperboard products. When looking at this from the environmental point of view, waste becomes an income instead of cost when used packages are sold to the recycled fiber markets. Recyclability is one of the key advantages of the products according to the present invention.

Furthermore the flexibility of the described process using modern technology means that production losses due to grade changes are minimal ensuring the high productivity of the manufacturing equipment.

The dispersion coating chemicals used in the present invention to get the recyclability may further be changed into biodegradable type of chemicals. However, the demand of those chemicals is low at the moment as the costs are presently still high. It is to be expected though that the biodegradable dispersion manufacturers will in the future adjust their prices to increase the demand. The higher the dispersion volumes, the lower will be the production costs for the chemical producers.

Figure 2A:
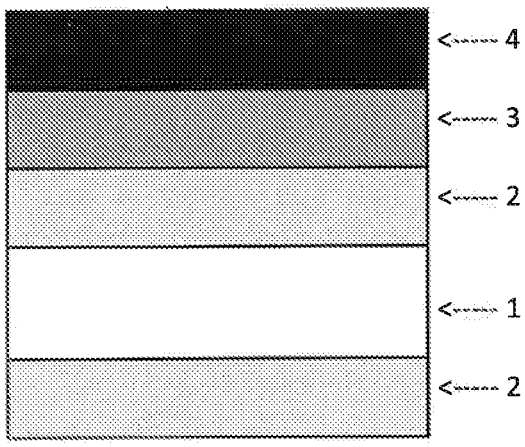
Figure 2B:
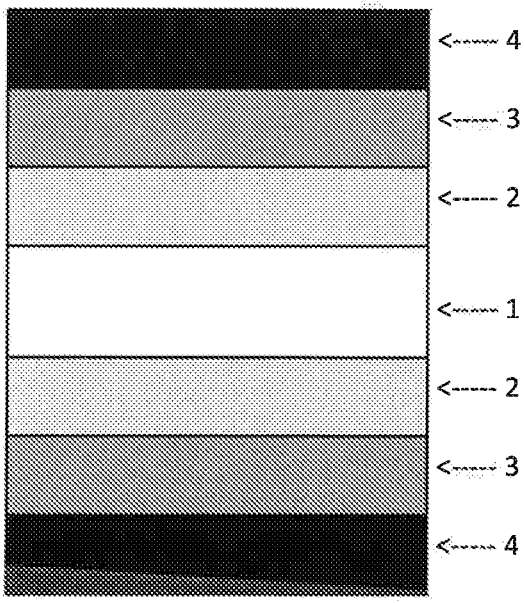
Figure 3A:
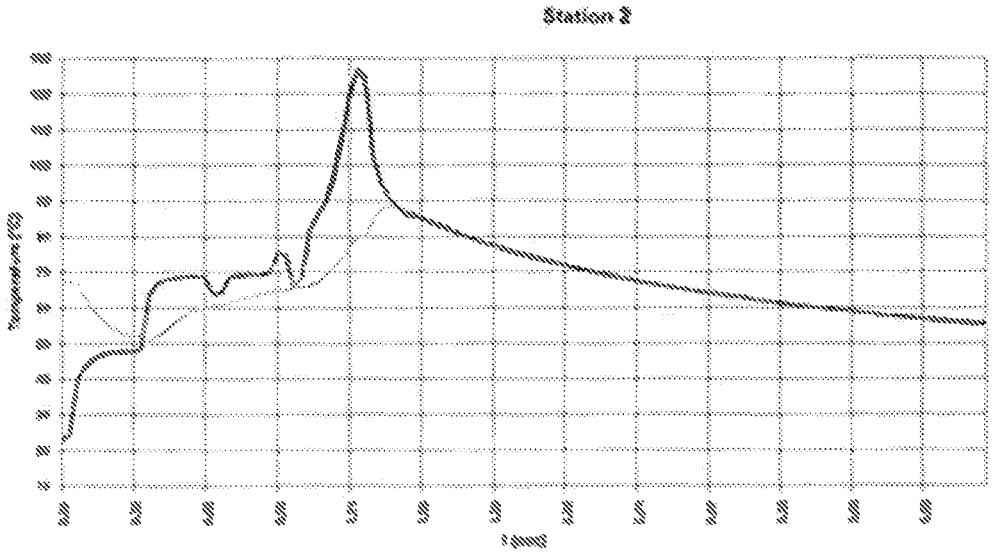
Figure 3B:
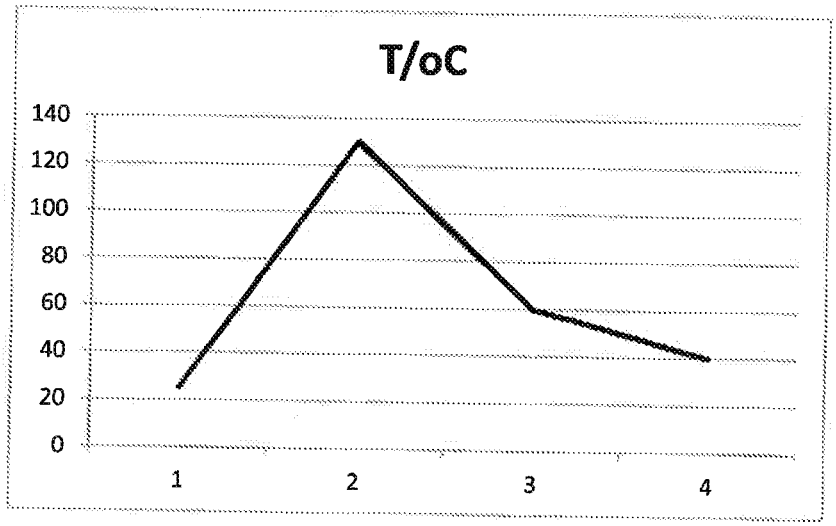

Some embodiments of the present invention are described in more detail below with reference to the enclosed schematical figures, in which FIG. 1 depicts schematically an online system according to one embodiment of the present invention, FIG. 2A-2B depict schematically coated paperboards obtained according to some embodiments of the present invention, FIG. 3A depicts measured temperature from the paperboard surfaces, and FIG. 3B depicts the predetermined temperature setting profile according to the present invention.

An exemplary embodiment depicting an online system according one embodiment of the present invention is depicted in FIG. 1 schematically. In FIG. 1 the following abbreviations are used: A=wire section; B=press section; C=drying section; D=coating section; and E=winding to jumbo reel.

In an exemplary embodiment of the present invention the coating section comprises a precoating unit, where the web enters in between the rolls of the precoater, and subsequently the web is guided through the post drying section.

The coating unit comprises a curtain coater. A preferred curtain coater may coat two or three layers simultaneously on a base paper web. The curtain coating unit is followed by a heating unit.

The sections of FIG. 1 are further explained in example 1.

FIGS. 2A and 2B depict the some embodiments of the preferred coated paperboard structures. In FIG. 5A three layers of coating are on the both sides and in FIG. 5B three layers of coating are only on one side.

The resulting multilayer structure is depicted in FIGS. 2A and 2B wherein 1=base paperboard, 2=precoating layer, 3=barrier layer and 4=heat sealable coating layer.

In one embodiment the heat sealable coating layer on top of the precoating and barrier layers if heated according to the heating profile of FIG. 3B. The three heating units whereby the web is passing after application of the third coating composition for forming the heat sealable coating layer are adjusted to 130° C., 60° C. and 40° C. The actual measured temperature experienced by the web is disclosed in FIG. 3A.

The present invention is further illustrated by the following non-limiting examples.

EXAMPLES

Example 1

FIG. 1 shows schematically the sections of one paperboard system according to the present invention. The sequence of the sections is the following:

A Wire section wherein water is removed from stock with gravity and suction through a wire. Dry content about 0.5% to about 20%

B Press section wherein water is removed by pressing web. Dry content about 20% to about 50%.

C Drying section wherein water is removed by heating paperboard with the help of steam in drying cylinders. Dry content about 50% to about 95%.

D Coating section wherein web is coated and dried several times. Final dry content is about 90%. The coating section further comprises the following units:

- precoating
- calendering
- 1st curtain
- 2nd curtain
- calendering
- cooling
- optional surface charging E Winding to jumbo reel

Example 2

The paperboard production system according to the invention was used to produce cups for hot beverages, such as coffee.

Final caliper of the paperboard product aimed at was 300 μm. The following production parameters and sequence were applied:

- Base paper thickness was 200 g/m$^2$
- Precoating layer thickness was 10 g/m$^2$ on each side of the paperboard
- Calendering was performed after precoating to close the surfaces
- Curtain coating was used to coat the inside surface of the cup paperboard by 6 g/m$^2$ barrier coating layer and 8 g/m$^2$ heat sealable coating layer, the dispersions were applied accordingly based on flow meter measurement results.
- Temperature was controlled and adjusted for the paperboard web for 150° C. and then the web was cooled down to 50° C.
- Final calendering was performed to reach the required target caliper of paper before directing the paperboards to winding.

A structure according to FIG. 2A was thus obtained.

This on-line produced product was used to successfully to make cups by the cup producer. The cups were rigid and their sealing properties were excellent (heat sealable function). Barrier properties were good as hot water or coffee did not penetrate into the paperboard product within a time period of 12 h.

Possible waste in production was reused as the paperboard product produced by the present method is recyclable without requiring any intermittent processing or treatment.

Example 3

The paperboard production system according to the invention was used to produce cups for cold beverages.

Final caliper of the paperboard product aimed at was 330 μm. The following production parameters and sequence were applied:

- Base paper 200 g/m$^2$.
- Precoating 10 g/m$^2$ on each side.
- Calendering to close the surface.
- Curtain coating on inside surface: 6 g/m$^2$ for barrier coating layer, 8 g/m$^2$ for heat sealable coating layer.

Temperature control, web 150 C and then cooled down to 50 C.

Curtain coating on outside surface: 3 g/m$^2$ for barrier coating layer, 3 g/m$^2$ for heat sealable coating layer.

Temperature control for web 150° C. and then cooled down to 40° C.

Final calendering to reach needed caliper of paper.

Outside surface of the paperboard for the cup was treated electrically using 25 W/m$^2$/min to reach 60 dyn/cm surface tension.

A structure according to FIG. 2B was thus obtained.

This on-line produced paperboard product was used to successfully make cups by the cup producer. The cups were rigid and sealing properties were excellent (heat sealable function). Barrier properties were good as liquids did not penetrate into the product within a time period of 12 h. Outside of cup provided enough barrier against condensate water.

Possible waste in production was reused as the paperboard product produced by the present method is recyclable without requiring any intermittent processing or treatment.

Example 4

Fast food company used two different waste cups: a dispersion coated cup according to the present invention and a PE(polyethylene)-extruded cup. The traditional PE-extruded cups had to be treated as waste and therefore the fast food company had to pay an external party to collect the used cups and either burn or process them in a PE eliminating process. Dispersion coated cups were treated as recyclable paperboard and they could be sold accordingly.

The invention claimed is:

1. A method for manufacturing coated paperboard by providing a repulpable multilayer coating on a first surface of a paperboard web in a paper manufacturing system comprising a precoating unit, a curtain coating unit, an adjustable heating unit, a cooling unit, and a jumbo reel onto which resulting multilayer coated paperboard is reeled, the method comprising a) forming a precoating layer directly onto the first surface by applying 4-20 g/m$^2$ of a first coating composition in a precoater which is a size press or a metering size press, said first coating composition comprising inorganic mineral pigment particles selected from particles of calcium carbonates, and kaolin, and at least one binder selected from synthetic polymer latex, polyvinyl alcohol and starch for sealing the first surface of the paperboard web, b) forming at least one barrier coating layer directly on the precoating layer by applying a second coating composition in form of an aqueous polymer dispersion in the curtain coating unit, wherein the aqueous polymer dispersion is selected from latex dispersions, polyvinyl alcohol dispersions and polyolefin dispersions and wherein the second coating composition is applied in an amount of less than 20 g/m$^2$, and c) forming at least one heat sealable coating layer directly on the at least one barrier coating layer by applying a third coating composition consisting of a polymer dispersion in the curtain coating unit, wherein the second and third coating compositions are applied simultaneously as aqueous dispersions without intermediate drying in between application of the coating compositions, and the third coating composition forms the outermost surface of the coated paperboard, d) allowing the third coating composition to partially or fully melt in the heat sealable coating layer to form a film surface by controlling and adjusting the temperature of the coated paperboard web to a temperature of 90-150° C., and e) cooling the paperboard web in at least one cooling unit to reduce tackiness of the coated paperboard web before reeling to the jumbo reel.

2. The method according to claim 1, wherein the temperature of the paperboard web after the temperature adjustment is cooled down to a temperature below 50° C.

3. The method according to claim 1, wherein the paperboard web is calendered after forming the precoating in step a) and/or after cooling in step e).

4. The method according to claim 1, wherein the precoating is also formed on a second surface of the paperboard web.

5. The method according to claim 1, wherein at least the first surface of the paperboard is exposed to electrical surface modification treatment before winding the coated paperboard web onto jumbo reel.

6. The method according to claim 5, wherein the surface energy of the first surface of the coated paperboard web is charged by the electrical surface modification treatment.

7. The method according to claim 5, wherein the electrical power used in the electrical surface modification treatment is less than 50 W/m$^2$/min.

* * * * *